United States Patent [19]

Aleshire et al.

[11] 3,990,540

[45] Nov. 9, 1976

[54] CHECKOUT SYSTEM

[75] Inventors: Rex A. Aleshire, Byesville; Floyd G. Speraw; Harold J. Sampson, both of Cambridge, all of Ohio

[73] Assignee: NCR Corporation, Dayton, Ohio

[22] Filed: Sept. 4, 1975

[21] Appl. No.: 610,484

[52] U.S. Cl. ..... 186/1 AC; 186/1 A; 312/282

[51] Int. Cl.[2] ..... A47F 9/02

[58] Field of Search..... 186/1 A, 1 AC; 312/282, 312/313, 314, 140.3

[56] References Cited

UNITED STATES PATENTS

| | | | |
|---|---|---|---|
| 2,122,969 | 7/1938 | Whitcomb | 312/314 |
| 2,317,438 | 4/1943 | Bradley | 186/1 A |
| 2,631,689 | 3/1953 | Rubaloff | 312/140.3 |
| 2,964,134 | 12/1960 | Bisen | 186/1 A |
| 3,077,950 | 2/1963 | Brown | 186/1 A |
| 3,557,907 | 1/1971 | Close | 186/1 AC |
| 3,558,204 | 1/1971 | Elliot | 312/313 |
| 3,628,632 | 12/1971 | Lambert | 186/1 AC |
| 3,789,957 | 2/1974 | Close | 186/1 AC |

*Primary Examiner*—George E. A. Halvosa
*Assistant Examiner*—Reinhard J. Eisenzopf
*Attorney, Agent, or Firm*—J. T. Cavender; Wilbert Hawk, Jr.; Richard W. Lavin

[57] ABSTRACT

There is disclosed a checkout system for use in a supermarket or other retail merchandise store or the like. The checkout system includes a stand alone label scanner device for scanning data bearing labels on the merchandise items and a bag supporting cart pivotally secured at one end to the floor adjacent the scanning device for supporting bags in an open position to receive merchandise items. Associated with the bagging cart is a counter shelf member pivotally attached to the cart. Slidably mounted on the shelf member is a shelf extension member. In one mode of operation the cart is positioned adjacent the discharged end of the scanning device to allow the checkout operator to move in one motion the merchandise items past the scanning device and into a bag located on the cart. In a second mode of operation, the cart is pivoted away from the scanning device where the counter shelf and its extension are moved to a position engaging the scanning unit to allow a bagger operator to continue to receive items from the scanning unit for loading into the same bags. The use of a bagging cart which can be selectively mounted on the floor in any position with respect to the checkout area allows the arrangement of the checkout area to be varied depending on the overall checkout system desired.

25 Claims, 9 Drawing Figures

CHECKOUT SYSTEM

CROSS-REFERENCE TO RELATED APPLICATIONS

United States application entitled "Checkout System" of Floyd G. Speraw, Thomas M. Hess and Harold J. Sampson, filed may 8, 1975, Ser. No. 368,120.

BACKGROUND OF THE INVENTION

Field of the Invention

This invention relates, in general, to checkout systems for retail stores and the like and more particularly to checkout systems which includes an optical reader for reading coded labels on merchandise items and which further includes means for bagging the merchandise items after they have been read by the optical reader.

Description of the Prior Art

This invention is an improvement of the checkout system disclosed in the above-cited United States application Ser. No. 468,120 and which is assigned to the assignee of the present application. As disclosed in that application, there is provided a bagging cart in combination with a checkout counter in which the bagging cart is movable between a position adjacent the discharge end of the counter wherein the checkout operator can bag the merchandise items as they are checked out and a position away from the operator wherein a bagger operator can continue the bagging operation. Included in the checkout counter is an optical reader located adjacent the checkout operator and a support portion of the counter extending downstream of the optical reader to which the bagging cart is rotatably secured. A counter shelf is pivotally mounted to the rear of the cart for positioning between the cart and the checkout counter adjacent the optical reader when the cart is in the away position allowing the checkout operator to move merchandise items from the discharged end of the optical reader to the cart where the bagger can continue the bagging of the merchandise itmes. It was found that in checkout operations using this cart arrangement, the use of the optical reader produced such a high checkout rate of merchandise items that the bagger operator was unable to bag all the items resulting in the counter shelf being filled with checkout merchandise items. When this condition occurred, the checkout operation was stopped until all the items on the counter shelf was bagged. In trying to eliminate this condition, it was determined that a larger shelf would solve the problem but it was discovered that the length of the counter shelf was determined by the location of the pivot point of the cart to the counter and the height of the pivot point of the counter shelf on the cart. It is therefore a primary object of this invention to provide a bagging cart construction which can accommodate a pivoted counter shelf whose support area can be varied to support a sufficient number of merchandise items so as not to interfere with the checkout operation. It is a further object of this invention to provide a bagging cart construction which allows the bagging cart to be selectively located with respect to the discharge area of a checkout counter. It is another object of this invention to provide a bagging cart which can be used within different checkout system arrangements.

SUMMARY OF THE INVENTION

In order to carry out these objects, there is provided a moveable bagging support member or cart having a bag supporting surface and a horizontally extending hinge member secured to one end of the cart, the hinge member being rotatably secured to a support member mounted on the floor downstream from the discharge end of an optical label reader which is part of the checkout system. Pivotally mounted to the rear of the cart is a counter shelf assembly which includes a counter shelf and a shelf extension member slidably secured to the free end of the counter shelf. The bagging cart is selectively secured to the floor with respect to the discharge area of the optical reader so that the bagging cart is rotatable between a position adjacent the discharge area of the optical reader to support bags for receiving merchandise items from the checkout operator and a position away from the discharge end of the optical reader wherein the counter shelf is rotated to a generally horizontal position and the shelf extension extended to a position engaging the discharge end of the optical reader to support merchandise items from the discharge end to the bagging cart where a bagger operator will continue bagging the merchandise items.

DESCRIPTION OF A PREFERRED EMBODIMENT

Figure 1:
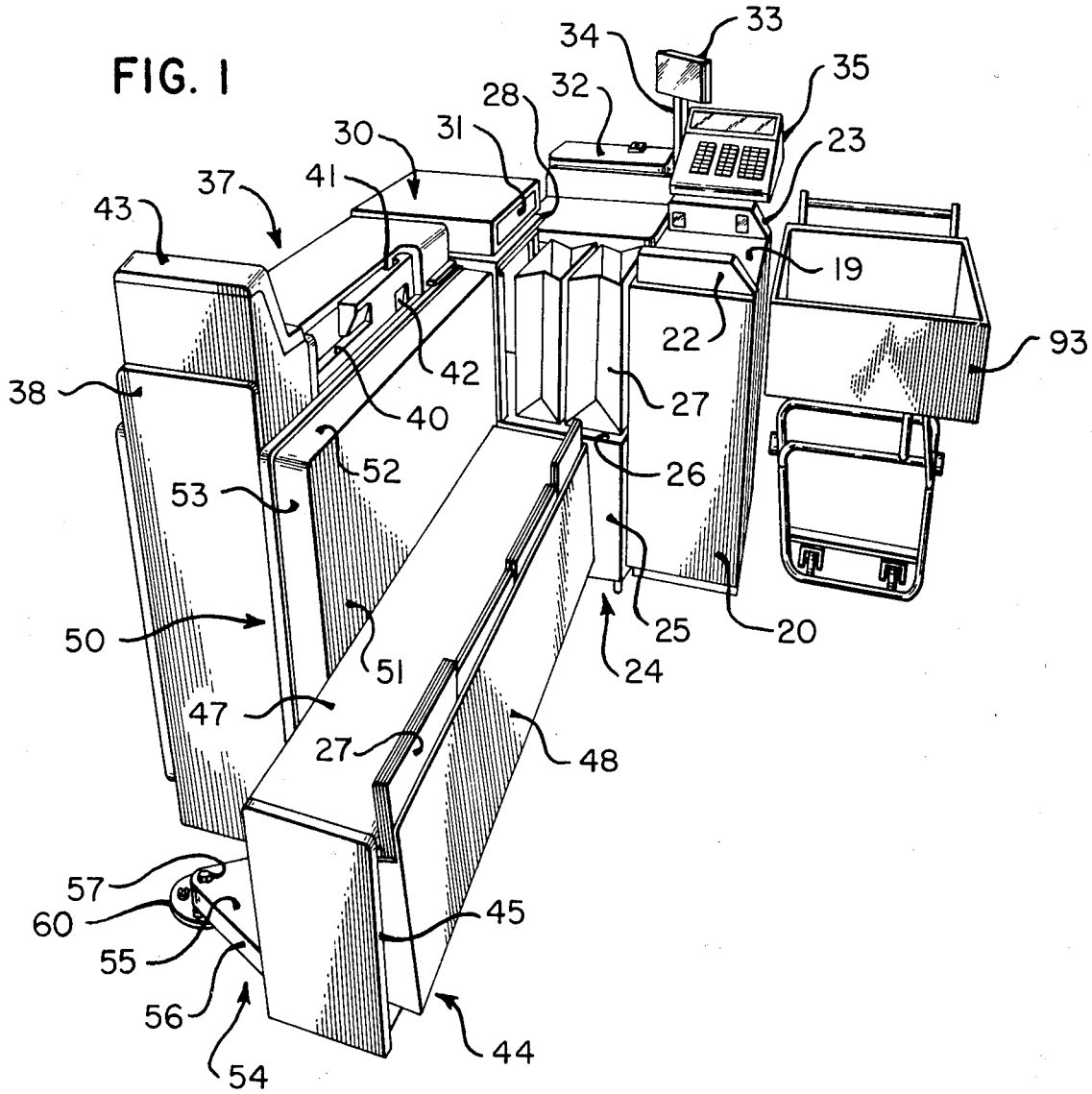
FIG. 1 is a perspective view of one type of a checkout system showing the bagging cart in a position to allow the checkout operator to check out and bag the merchandise items.
Figure 3:
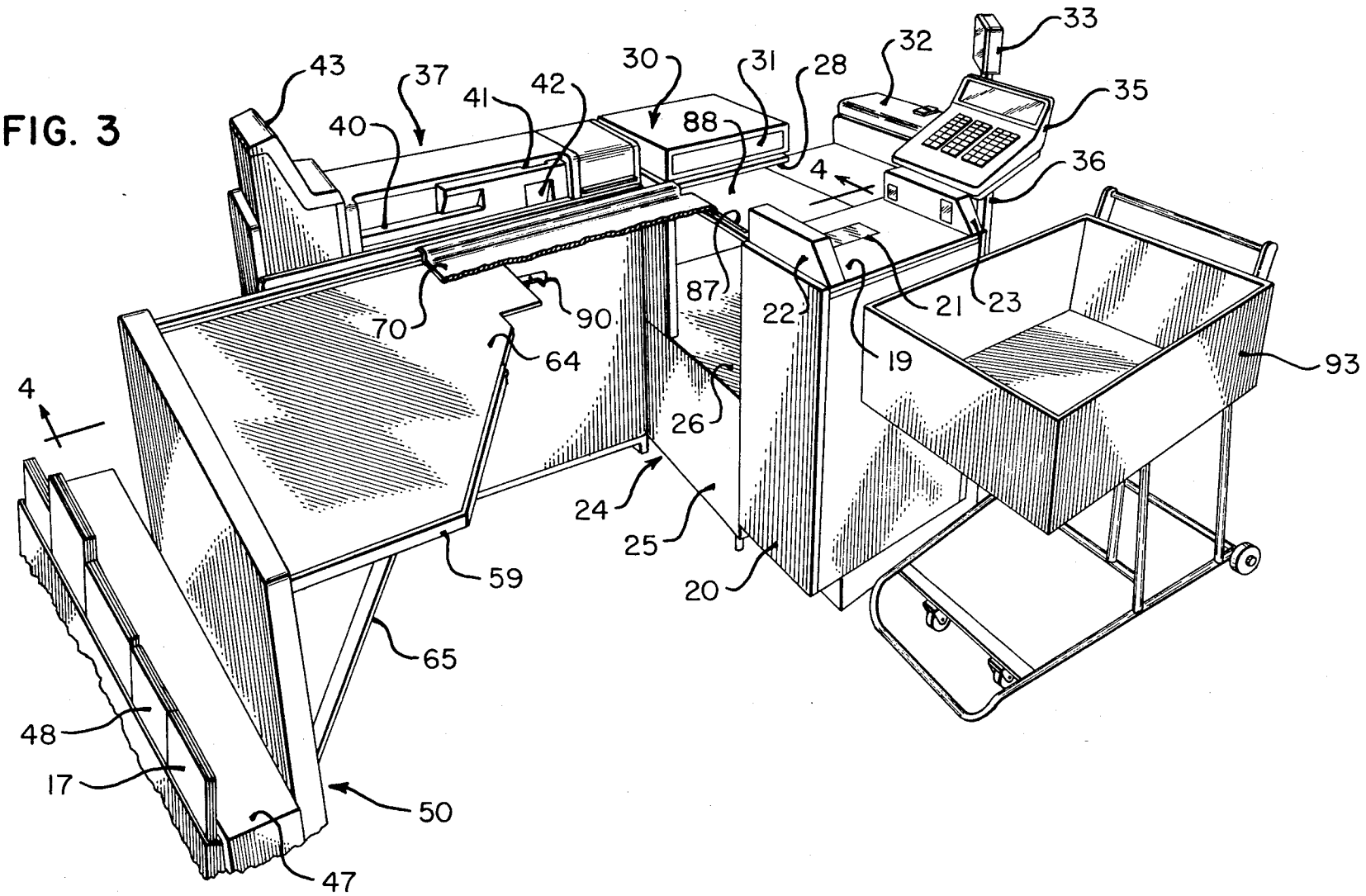
FIG. 3 is a perspective view of the checkout system of FIG. 1 showing the bagging cart rotated 90° with the counter shelf and shelf extension engaging a support member positioned adjacent the optical reader.

Referring now to FIGS. 1 and 3, there is shown one form of a checkout system which includes a free-standing housing 20 in which is mounted an optical reader apparatus (not shown) for reading through a window 21 (FIG. 3) located in the top surface 19 of the housing 20 coded labels on merchandise items which are moved past the window 21 by the checkout operator. A pair of rails 22, 23 mounted adjacent the top surface 19 of the housing 20 forms a passage through which the merchandise items are moved from right to left as viewed in FIGS. 1 and 3 for reading by the optical reader as part of the checkout operation.

Positioned adjacent the discharge end of the housing 20 is a fixed bag supporting structure generally indicated as 24 and having side walls 25 and a horizontal support surface 26 located below the top surface 19 of the optical reader housing 20 on which surface 26 are placed bags 27 (FIG. 1) for receiving merchandise items from the checkout operator after the items have been scanned by the optical reader in the housing 20. Located on a top surface 28 (FIG. 4) of the structure 24 is a cash drawer housing 30 in which is mounted a cash drawer 31 for receiving payment from the customer for the merchandise items purchased.

Positioned upstream of the bag support structure 24 on a support member (not shown) is a scale 32 on which purchased items are weighed. Located adjacent the scale 32 is a remote display unit 33 mounted on a stand 34 which will display the cost of the items being checked by the optical reader and the total amount owed by the customer for the merchandise. Positioned upstream of the optical reader housing 20 is a remote keyboard 35 mounted on a stand 36 (FIG. 3) for inputting merchandise data concerning the merchandise operation.

Extending downstream of the cash drawer housing 30 is a printer control unit generally indicated as 37, which comprises a housing member 38 in which is located a printer (not shown) for printing data on several record members, specifically, a journal member, a receipt member or a slip member. As is well known in the art, the printer will print data concerning each merchandise transaction on the journal member and on either the receipt member or the slip member, depending on whether a slip member is required as part of the transition. Where a slip member is involved, the operator will insert the slip on the slip table 40 located at the top of the housing 38.

Located adjacent the slip table 40 is a slot 41 out of which the receipt member projects after a printing operation has occurred, the receipt member being available to be removed by either the customer or the checkout operator. Located below the slot 41 is a recessed area 42 in which is located the journal member for viewing by the checkout operator. Mounted on the housing 38 is a coin dispenser 43 which will dispense change to the customer in accordance with the amount tendered by the customer. Each of the housings 20, 28, the support structure 24, the scale 32, the display 33 and the keyboard 35 are free-standing units which may be arranged to form different checkout configurations as will be described more fully hereinafter.

Figure 4:
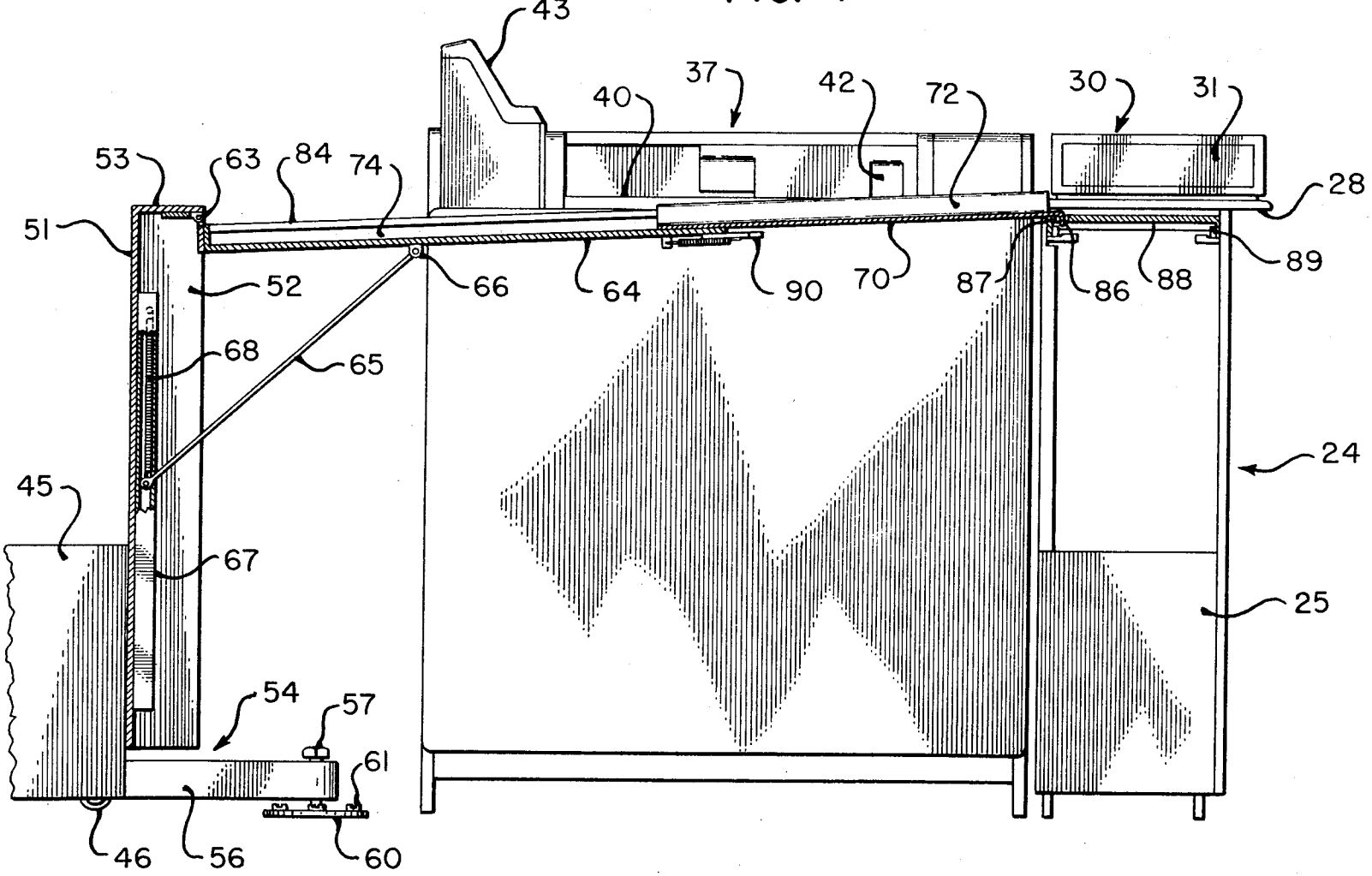
FIG. 4 is a sectional view taken on lines 4—4 of FIG. 3 showing details of the structural connection of the counter shelf and the shelf extension to the cart and to the support member.

Referring to FIG. 1, there is shown positioned adjacent the printer control unit 37 the improved moveable bagging support member of the present invention, in the form of a cart 44. The bagging cart 44 includes a box-like base member 45 to which is mounted on castors, or rollers 46, one of which is shown in FIG. 4, to allow for movement of the cart. The top surface 47 of the base member 45 acts as a support surface for merchandise bags 27 of the type shown positioned on top of the structure 24. Hinged to the front of the base member 45 is a door member 48 which is biased to a closed position by springs (not shown) or any other suitable biasing means. Positioned between the door 48 and the base member 45 is a supply of bags 27 in folded upright position for use by the checkout operator or the bagger operator when a new bag is required for bagging the merchandise items. Inside of the base member 45 is a storage compartment (not shown) for storing bags 27 prior to being mounted between the door member 48 and the base member 45.

Figure 2:
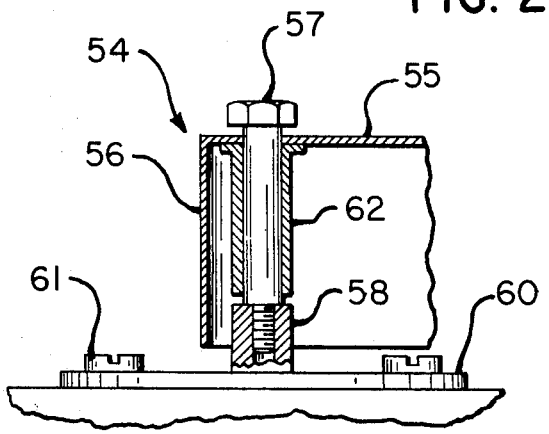
FIG. 2 is an enlarged sectional view of the bagging cart hinge and its associated floor mounting apparatus.

Secured to the rear of the base member 45 is a box-like wall structure 50 (FIGS. 1, 3 and 4) which includes a side wall member 51 extending along a portion of the width of the base member 45, a top edge member 52 and two side edge members 53. As best seen in FIGS. 1, 2 and 4, mounted to the lower rear edge of the base member 45 adjacent the wall structure 50 by any suitable fastening means, is a horizontally extending hinge member generally indicated as 54 having top 55 and side 56 walls forming a triangular structure. The hinge member 54 is rotatably mounted on a bolt 57 which is secured to the floor or like permanent structure by any suitable means. There is disclosed in FIG. 2 one means of securing the bolt 57 to the floor, which includes mounting the bolt in a flange portion 58 of a pivot plate 60 attached to the floor by means of bolts 61 or other suitable mounting means. Secured to the underside of the top wall 55 of the hinge member 54, by any suitable means such as welding, is a bearing sleeve 62 within which the bolt 57 extends. It will be obvious from this construction that the bagging cart 44 will ride on the rollers 46 around the bolt 57 when moved by the operator between a position where the end of the bagging cart is adjacent the optical reader housing 20 and the checkout operator as shown in FIG. 1 and an away position as shown in FIG. 3 where the cart is turned 90° to allow a bagger operator to bag the merchandise items checked out by the checkout operator.

As best seen in FIG. 4, pivoted to the underside of the top edge member 53 of the wall structure 50, by means of a hinge 63, is a counter shelf member 64 including a side rail 59 (FIG. 3) and which is swung between a closed position within the wall structure 50 as shown in FIG. 1 and an open position extending in a generally horizontal direction as shown in FIG. 3. Associated with the counter shelf 64 are three support arms 65, one of which is shown in FIGS. 3 and 4. Each arm 65 has one end mounted to a hinge member 66 secured to the underside of the shelf 64 with the other end slidably disposed in a channel member 67 secured to the side wall member 51. A spring 68 secured to the top of the channel 67 engages the end of the arm 65 and functions as a counter balance to the weight of the shelf 64 and also assists in the movement of the shelf 64 when rotated from a closed to an open position. For a more detailed disclosure of the mounting of the arm 65 within the channel member 67, reference should be made to the previously cited Speraw et al. application Ser. No. 468,120.

Associated with the counter shelf 64 is a shelf extension 70 (FIGS. 4 and 6) slidably mounted on the shelf 64. The shelf extension 70 includes a pair of bent-over side rail portions 71, 72 (FIG. 6) which are slidably mounted on side rails 73, 74 respectively, secured to the side of the counter shelf 64 by means of screws 69 or the like. Secured to the side rail 71 by any suitable fastening means is a guide member 75 which in this case is made of wood but can be of any construction which will function for the purpose intended. The guide member 75 is slidably positioned within a pocket formed by a top 76 and bottom 77 flange portions of the rail 73. Likewise, a similarly constructed guide member 78 is secured to the rail 72 by means of screws 80 and which is slidably positioned within a pocket formed by the top 81 and bottom 82 flange portions of the rail 74. In addition, the top of the rail 72 is bent over a second guide member 83 having the same construction as guide members 75 and 78 and secured to an upstanding flange portion 84 of the rail 74 by means of screws 85. Both the guide members 75, 78 extend a distance which is approximately equal to the length of the rails 71, 72.

As best understood from FIG. 3, upon swinging of the counter shelf 64 to a horizontal position, the shelf extension 70 will be extended to a position where a bent over front portion 86 of the shelf extension 70 (FIG. 6) will be inserted into a slot 87 located on a shelf 88 slidably mounted on rollers 89 (FIG. 4) within the support structure 28. The shelf 88 may be pulled out by the checkout operator to be positioned between the top surface 19 of the optical reader housing 20 and the support structure 28, thereby covering over the bag area above the horizontal support surface 26 of the bag supporting structure 24. While the shelf 88 is disclosed in the present embodiment as supporting the shelf extension 70, it is obvious that other support elements such as a rail member may be positioned between the structure 28 and the housing 20 to accomplish the same result.

Figure 6:
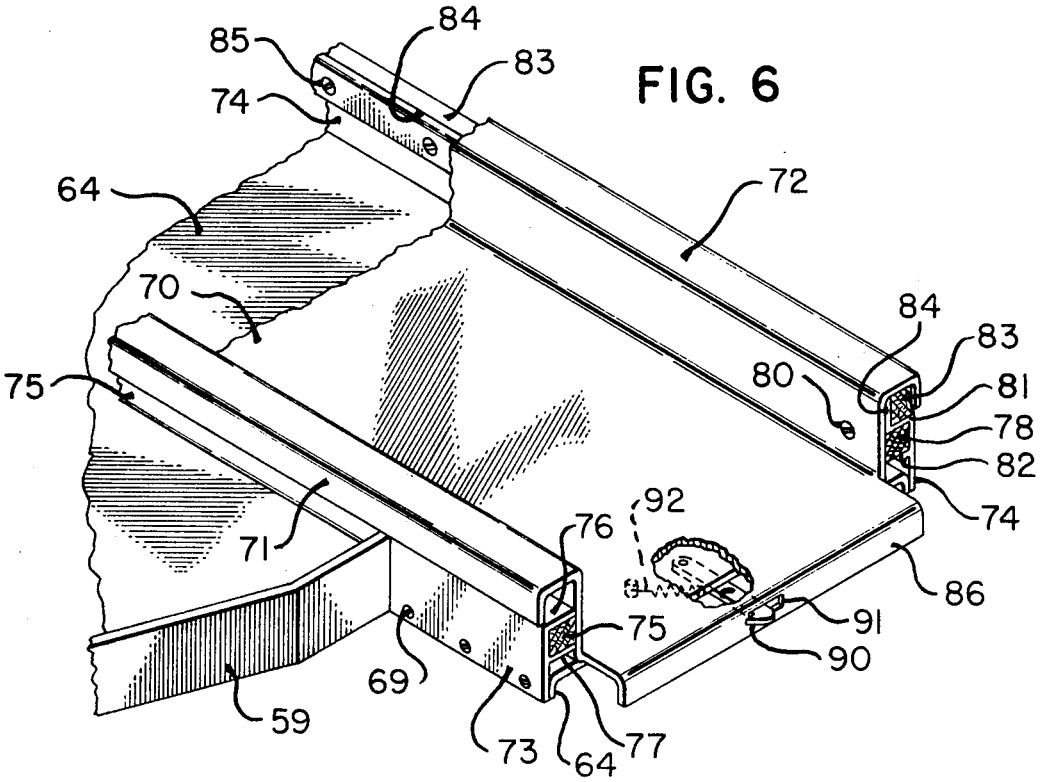
FIG. 6 is a fragmentary perspective view of the counter shelf extension with details of its structural mounting to the counter shelf.

As best seen in FIG. 6, rotatably mounted to the underside of the front portion of the shelf 64 is a latch member 90 which cooperates with a slot 91 located in the front portion 86 of the shelf extension 70 to latch the extension to the shelf 64 when in the home position. A spring 92 normally urges the latch member 90 into a latching position to hold the shelf extension 70 in a retracted or home position. By rotating the latch member 90 against the action of the spring 92, the checkout operator can disable the latch member 90 and slide the extension 70 to any extended position where it is secured to the shelf 88 in the manner described previously.

In operation, the bagging cart 44 is selectively positioned with respect to the discharge area of the checkout system employed. In regard to the system disclosed in FIGS. 1 and 3, the optical reader housing 20 is orientated so that the checkout operator standing adjacent the reader is able to remove items directly from a grocery or merchandise cart 93 (FIGS. 1 and 3) which has been positioned adjacent the entrance of the housing 20, move the items across the optical reader and then bag the items in the bags 27 located on the support structure 24. This checkout operation requires only one movement by the operator, thereby allowing the checkout operation to occur in a minimum of time.

In this checkout system the bagging cart 44 (FIG. 1) is positioned downstream of the optical reader housing 20 by mounting the pivot plate 60 to the floor so that when in a closed position, the bag support surface 47 of the cart 44 is positioned adjacent the checkout operator and the open bags 27 are on the bag supporting surface 26. In this position, the checkout operator can move the bags 27 (FIG. 1) when filled from the surface 26 of the structure 24 onto the surface 47 of the bagging cart or remove a new bag from the supply held by the door 48 of the cart and position the bag on the surface 47 to continue the checkout operation.

If during the checkout operation the number of customers waiting to be checked out increases, the cart 44 is swung about the pivot plate 60 to the open position shown in FIG. 3. The counter shelf 64 is then rotated to a generally horizontal position, and the extension 70 unlatched and moved to a position engaging the shelf 88 which has been pulled out and positioned between the optical reader housing 20 and the support member 28.

As shown in FIG. 4, the shelf 88 is located at a slightly higher elevation than that of the shelf 64, resulting in the shelf 64 and the extension 70 extending at a slight incline towards the bagging cart 44 when mounted in an extended position. This sloping of the shelves aids in moving the merchandise items from the discharge area of the optical reader to the bagging cart. It will be obvious that this position of the cart 44 will allow the checkout operator to continue to check out the items from the merchandise cart 93 and move the items over the extension 70 and the counter shelf 64 to the bagging cart where the items are then positioned within the bag 28 located on the support surface 47 by a bagger operator. Thus, the check-out operation of the purchased items of a customer can be continued with minimum interruption when the bagging operation is transferred from the checkout operator to the bagger operator.

It is desirous that when in a closed position the supporting surface 47 of the cart 44 be positioned adjacent the checkout operator (FIG. 1) and when in an open position (FIG. 3) the shelf extension 70 be in approximately the same position. By mounting the hinge member 54 offset to the rear of the bagging cart 44, the cart will be positioned to accomplish both of these conditions.

Figure 5:
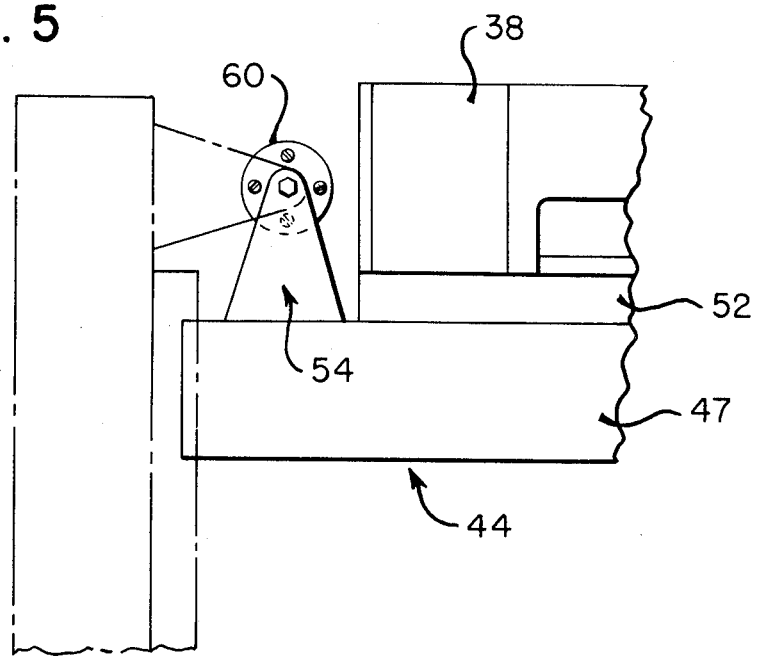
FIG. 5 is a fragmentary top view of the bagging cart hinge showing the position of the cart in its two operating conditions.

As best seen in FIG. 5, when the bagging cart 44 is positioned adjacent a housing member 38, it is desirous that the counter shelf 64 and the shelf extension 70 be positioned adjacent the housing 38 when in an open and closed position. This is accomplished by locating the pivot plate 60 an equal distance from the side edge of the housing 38 and the front edge of the housing 38 adjacent the cart.

Figure 7:
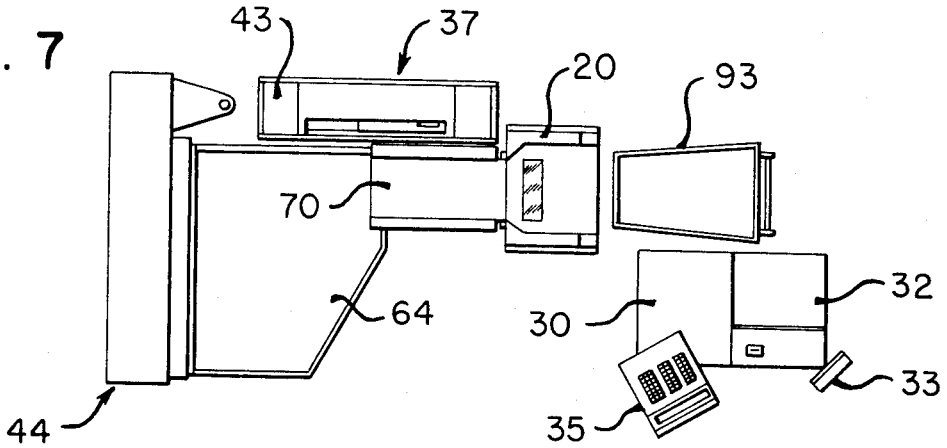
FIG. 7 is a plan view of an alternate checkout system showing the bagging cart in an open position.
Figure 8:
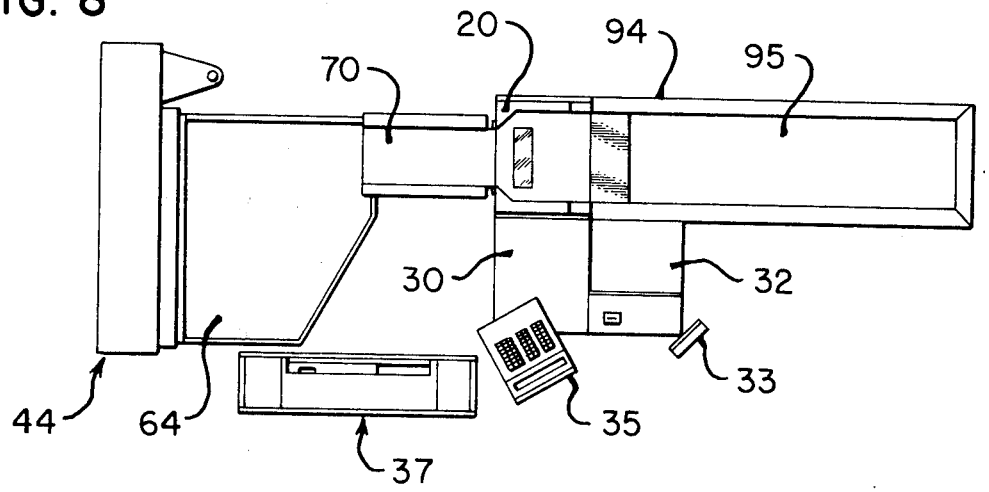
FIG. 8 is a plan view of another alternate check-out system showing the bagging cart in an open position.
Figure 9:
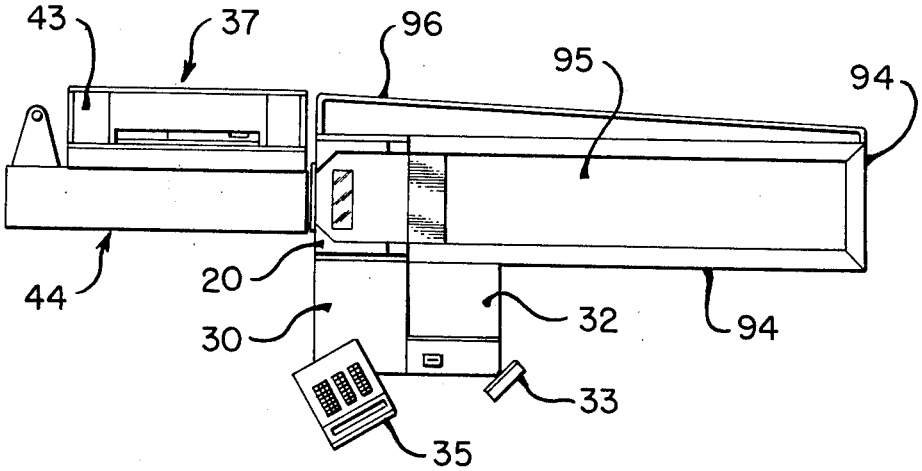
FIG. 9 is a plan view of another alternate check-out system showing the bagging cart in a closed position.

Referring now to FIGS. 7–9 inclusive, there is disclosed alternate checkout systems in which the bagging cart 44 of the present embodiment may be employed. In FIG. 7, the checkout system has the optical reader housing 20 orientated parallel with the extension 70 of the bagging cart so that the extension engages the discharge end of the optical reader housing 20 with a merchandise cart 93 positioned adjacent the entrance end of the housing 20. The cash drawer 30 and the scale 32 are positioned away from the housing 20 to allow the operator to directly remove the items from the merchandise cart 93 and move the items through the optical reader to either directly bag the items when the bagging cart 44 is in a closed position or to move the items over the shelf extension 70 and the shelf 64 to a bagger who will bag the items when the bagging cart is in the away position as shown in FIG. 1. In this arrangement, the customer will position the merchandise cart 93 adjacent the entrance of the optical reader housing 20.

In FIG. 8 there is shown the optical reader housing 20 positioned at the end of a counter 94 which includes a conveyor belt 95 for conveying merchandise items from the entrance of the counter to the optical reader housing 20 where the operator will check out the items. The printer unit 37 is positioned so that it is accessible only to the operator, while the merchandise cart 93 (not shown) is positioned adjacent the entrance of the checkout counter 94 where items are loaded on the conveyor belt. In FIG. 9, the arrangement is the same as that shown in FIG. 8, except that the printer unit 37 is positioned with respect to the bagging cart 44 as was shown in FIG. 7, allowing both the customer and the operator access to the printer unit. A guide surface 96 is mounted to the front of the counter 94 to control the position of the customer with respect to the counter 94 and the printer unit 37. In both FIGS. 8 and 9, the cash drawer 30, the keyboard 35 and the scale 32 are positioned for operator accessibility with the remote indicator 33 positioned to allow the customer to observe the costs making up his overall purchase.

It is seen with respect to the checkout systems just described that by constructing the bagging cart 44 to be pivoted to a support which is not a permanent part of the checkout counter allows the bagging cart to be easily incorporated into many and various modular checkout arrangements. It is obvious that this construction allows for changing the arrangement of the checkout system in accordance with business requirement without the necessity of purchasing new counter equipment.

While the present embodiment discloses only one shelf extension 70 mounted on the counter shelf 64, it is obvious that a plurality of extensions can be mounted on each other which are moved from a nested position to an extended position to provide more counter space in case it is found to be needed. With this arrangement, the bagging cart is mounted downstream of the checkout counter the required distance to accommodate the expanded length of the extensions. Again the number of extensions can be changed according to business requirement. Thus, the bagging cart 44 can be easily adapted to be used in any type of checkout system or provided with any number of extensions to accommodate any type of checkout requirement that may arise.

While the principles of the invention have now been made clear in the illustrated embodiment, it will be obvious to those skilled in the art that many modifications of structure, arrangements, elements and components can be made which are particularly adapted for specific environments and operating requirements without departing from these principles. As an example, while the bagging cart has been shown pivoted to the floor, it is obvious that the cart can be pivotally mounted to a horizontal support member which is attached to one of the system modules, for example, the printer unit 37 where both the cart and the printing unit are selectively positioned with respect to the discharge portion of the checkout system to accommodate the length of the counter shelf and its extension when the cart is moved to an open position. The appended claims are therefore intended to cover any such modification within the limits only of the true spirit and scope of the invention.

What is claimed is:

1. In combination with an article checkout means having a discharge area:

a. pivot means positioned remote from the discharge area of the checkout means;

b. bag supporting means pivotally mounted on said pivot means for movement between a position adjacent the discharge area of the checkout means and a position away from the discharge area;

c. and an article support means movably mounted on said bag supporting means, said article support means moveable to a position engaging the discharge area of the checkout means when the bag supporting means is in said away position whereby articles may be supported when moved from the checkout means to the bag supporting means.

2. The combination of claim 1 in which said pivot means comprises a support assembly secured to the floor supporting the article checkout means.

3. The combination of claim 2 in which said bag supporting means comprises a moveable cart having a wall member with a top edge portion, the combination including a pivot connecting member secured to said cart and rotatably mounted on said support assembly whereby said cart is moveable between a position adjacent the discharge area of the checkout means and a position away from the discharge area.

4. The combination of claim 3 in which said article support means includes a shelf member rotatably secured to the top edge portion of said wall member for movement between a folded position adjacent the wall member when the cart is positioned adjacent the discharge area and an extended position when the cart is in the away position, and a shelf extension slidably mounted on said shelf member, said shelf extension being moveable to a position engaging the discharge area of the article checkout means when the shelf member is in the extended position.

5. The combination of claim 4 in which said support assembly includes a mounting plate secured to the floor and a pivot support member secured to said mounting plate.

6. The combination of claim 5 in which said pivot connecting member comprises a hinge member extending from the cart and rotatably mounted to said pivot support member whereby the cart will pivot around the pivot support member when moved between the position adjacent the discharge area and the away position.

7. A checkout system comprising:

a. an article checkout member having an entrance portion and a discharge portion;

b. a pivot assembly remotely positioned downstream from the discharge portion of the article checkout member;

c. a moveable support structure adapted to support a bag member in an open position, said support structure pivotally mounted to said pivot assembly for movement between a first position adjacent the discharge portion of said article checkout member wherein the bag member is adapted to receive articles from the discharge portion and a second position remote from said discharge portion;

d. and a plurality of nested article support members moveably mounted on said support structure, said article support members moveable to an extended position engaging the discharge position of the article checkout member when the support structure is in said second position whereby articles are supported when moved from the checkout member to the support structure.

8. The checkout system of claim 7 in which said pivot assembly is secured to the floor supporting the article checkout member.

9. The checkout system of claim 7 in which said moveable support structure comprises a moveable cart member, and which includes an outwardly extending hinge member secured to said cart member and rotatably mounted on said pivot assembly whereby said cart member is moveable between said first and second positions.

10. The checkout system of claim 9 in which said article support members includes a shelf member rotatably secured to the cart member for movement between a folded position adjacent the cart member when the cart member is in said first position and an extended position when the cart member is in said second position and a shelf extension sliably mounted on said shelf member for movement between a nested position on the shelf member when the cart is in said first position and an extended position engaging the discharge portion when the shelf member is in the extended position whereby articles may be moved over the shelf member and the shelf extension from the discharge portion of the article checkout member to the cart member.

11. The checkout system of claim 9 in which said pivot assembly includes a mounting plate selectively secured to the floor and a vertically mounted connecting member secured to said mounting plate, said hinge member rotatably mounted on said connecting member whereby said cart member is moveable around said connecting member.

12. A checkout system including:

a. an article checkout member positioned on a floor support and having an entrance surface and a discharge surface;

b. a pivot assembly positioned on the floor support downstream of the discharge surface;

c. a moveable cart member rotatably secured to said pivot assembly, said cart member having a bag supporting surface for supporting a bag in an article receiving condition and a support surface extending along a horizontal plane, said cart member moveable between a first position wherein the bag supporting surface is positioned adjacent the discharge surface of said article checkout member to allow articles to be moved from the checkout member to a bag on said bag supporting surface and a second position downstream from said discharge portion;

d. an article support member rotatably mounted to said support surface for movement between a folded position adjacent the cart member when the cart member is in said first position and an extended position when the cart member is in said second position;

e. and an article support extension slidably mounted on said article support member for movement to a position engaging the discharge surface of the article checkout counter when the article support member is in an extended position whereby articles may be moved from the checkout member over the article support member and extension to the cart member when they are positioned within the bag.

13. The checkout system of claim 12 which further includes a horizontally extending hinge member secured to the bottom portion of the cart member, said hinge member rotatably mounted on said pivot assembly whereby said cart member is rotatable between said first and second position.

14. The checkout system of claim 13 in which said pivot assembly includes a support member secured to the floor support and a vertically extending pivot member mounted on said support member, said hinge member rotatably mounted on said pivot member for movement around said pivot member.

15. The checkout system of claim 14 in which said hinge member is secured to the cart member in an offset direction whereby the edges of the article support member and the extension when in an extended position will be positioned in the same plane as when the article support member and extension are in a folded position when the cart member is in said first position.

16. In combination with an article checkout member having a discharge portion:

a. a pivot assembly located remote from the article checkout member and downstream from the discharge portion;

b. a moveable support assembly having a horizontal surface for supporting a bag in an open position;

c. means for rotatably mounting one end of said support assembly to said pivot assembly for movement of the support assembly around a vertical axis between a first position wherein the free end of the support assembly and the horizontal surface is positioned adjacent the discharge portion of the checkout member and a second position wherein the free end of the support assembly is positioned remote from said discharge portion;

d. a first elongated article support connecting member;

e. means rotatably securing the first connecting member to said support assembly adjacent the horizontal surface for movement around a horizontal axis between a first position adjacent the support assembly when the support assembly is in said first position and a second position adjacent the discharge portion of the checkout member when the support assembly is in said second position;

f. a second elongated article support connecting member slidably mounted on said first connecting member for movement to a position engaging the discharge portion of the checkout member when the support assembly and the first connecting members are in said second position;

g. and means for supporting said first and second connecting members in said second position to support articles for movement from the checkout member to the support assembly wherein the articles are loaded into a bag located on the horizontal surface of the support assembly.

17. The combination of claim 16 which further includes a horizontally extending hinge member secured to the bottom portion of the support assembly, said hinge member rotatably mounted on said pivot assembly whereby said support assembly is rotatable between said first and second position.

18. The combination of claim 17 in which said pivot assembly includes a support member secured to the floor and a vertically extending pivot member mounted on said support member, said hinge member rotatably mounted on said pivot member for movement around said pivot member.

19. A checkout system including:

a. an optical reader positioned on a floor support and having an entrance surface and a discharge surface;

b. a pivot assembly positioned on the floor support downstream of the discharge surface of said optical reader;

c. a cart comprising a box-like structure having a top surface extending in a horizontal direction for supporting a bag in an open position;

d. means for supporting said cart for movement;

e. a wall member secured to said structure and having a pair of side edge portions and a top edge portion; the top edge portion of the wall member located generally in the plane of said discharge surface;

f. first means for rotatably mounting one end of said cart to said pivot assembly for movement around a vertical axis to allow the cart to be moved to a first position wherein the top surface of the box-like structure is positioned adjacent the discharge surface of the optical reader and to a second position wherein the top surface is aligned perpendicular to the first position of the top surface;

g. a first shelf member;

h. second means for rotatably mounting the first shelf member to the top edge portion of the wall member for movement around a horizontal axis between a vertical position adjacent said wall member when the cart is in said first position and a generally horizontal position when the cart is in said second position;

i. a second shelf member;

j. means for slidably mounting the second shelf member to the first shelf member for movement to a position engaging the discharge surface of the optical reader when the cart is in said second position;

k. and means for supporting the first and second shelf members in said second position to support articles for movement from said discharge surface to said cart.

20. The checkout system of claim 19 in which said first mounting means comprises a horizontally extending hinge member secured to the bottom portion of the cart, said hinge member rotatably mounted on said pivot assembly whereby thhe cart is rotatable between said first and second positions.

21. The checkout system of claim 20 in which said pivot assembly includes a support member secured to the floor support and a vertically extending pivot member mounted on said support member, said hinge member rotatably mounted on said pivot member for movement around said pivot member.

22. The checkout system of claim 21 in which said hinge member is secured to the cart in an off set direction whereby one edge of the shelf members will be positioned in the same plane when the shelf members are in a horizontal position and in a vertical position and the cart is in said first position.

23. The checkout system of claim 21 in which the optical reader is orientated in a direction perpendicular to the cart when the cart is in said first position to allow articles to be checked to be positioned adjacent the entrance surface of the optical reader.

24. The checkout system of claim 21 in which the optical reader is orientated in a direction parallel to the cart when the cart is in said first position, said checkout system includes a checkout counter having a discharge portion engaging the entrance surface of the optical reader to support articles for movement to the optical reader.

25. In a checkout system for checking merchandise items by a cashier receivied from a shopping cart, the combination including:

a. an optical reading member having an entrance surface positioned adjacent the shopping cart and a discharge surface, said reader member positioned on a floor support;

b. a first support member positioned adjacent the discharge surface for supporting a plurality of bags in a position for receiving merchandise items from said discharge surface;

c. a pivot assembly positioned on the floor support downstream of said discharge surface and said first support member;

d. a cart for supporting a plurality of bags in an open position, said cart comprising a housing member having a horizontally extending top surface defining a bag supporting surface;

e. a plurality of wheels mounted on the cart for moveably supporting the cart on the floor support;

f. a wall member having top and side portions secured to said housing, the top portion of said wall member extending in a horizontal direction and spaced above the bag support surface of the housing;

g. a horizontally extending hinge member secured to the bottom portion of said housing, said hinge member rotatably mounted on said pivot assembly to allow the cart to be moved around a vertical axis to a first position wherein the bag supporting surface of the housing is positioned adjacent the first support member and the discharge surface of the optical reader member and to a second position wherein the housing is aligned perpendicular to the first position of the housing;

h. a first shelf member;

i. means for rotatably mounting the first shelf member to the top portion of the wall member for movement around a horizontal axis between a vertical position adjacent said wall member when the cart is in said first position and a generally horizontal position when the cart is in said second position;

j. a second support member slidably mounted on said first support member for movement in a direction to engage the discharge surface of the optical reader member;

k. a second shelf member;

l. means for slidably mountting the second shelf member to said first shelf member for movement to a supporting position on said second support member when the cart is in said second position;

m. and means for supporting the first and second shelf members in said second position to support articles for movement from the discharge surface of the optical reader to the cart wherein the articles are positioned in bags located on the top surface of the housing.

* * * * *